United States Patent [19]

Ulrich

[11] Patent Number: 4,759,652

[45] Date of Patent: Jul. 26, 1988

[54] LOTION APPLICATOR SYSTEM

[76] Inventor: Tate B. Ulrich, 15120 Chelmsford Dr., Colorado Springs, Colo. 80921

[21] Appl. No.: 820,165

[22] Filed: Jan. 21, 1986

[51] Int. Cl.[4] ..... B41J 32/00; B41J 33/10; A61H 7/00

[52] U.S. Cl. ..... 401/196; 401/132; 15/222; 221/25; 206/226

[58] Field of Search ..... 401/196, 268, 208, 8, 401/132; 221/25, 135, 63; 24/508, 555, 499, 500, 458; 118/235; 206/210, 225, 409, 226; 225/106; 239/321; 222/190; 15/222

[56] References Cited

U.S. PATENT DOCUMENTS

| | | | |
|---|---|---|---|
| 702,289 | 6/1902 | De Baun | 15/222 |
| 934,724 | 9/1909 | Gravier | 15/222 |
| 2,333,436 | 11/1943 | Novick | 401/268 |
| 3,368,522 | 2/1968 | Cordis | 118/235 |
| 3,720,205 | 3/1973 | Liebman | 15/222 |
| 3,959,841 | 6/1976 | Horne | 401/8 |
| 3,986,479 | 10/1976 | Bonk | 118/506 |
| 4,112,536 | 9/1978 | Carson Jr. et al. | 15/104.93 |
| 4,175,306 | 11/1979 | Bigelow et al. | 24/253 |
| 4,566,606 | 1/1986 | Kling | 221/25 |

*Primary Examiner*—Richard J. Apley
*Assistant Examiner*—Franklin Gubernick
*Attorney, Agent, or Firm*—Dean P. Edmundson

[57] ABSTRACT

A lotion applicator system is described for applying lotions, oils and the like to various parts of the human body. The system includes a container and a continuous lotion-carrying strip therein. The free end of the strip is accessible through an aperture in the container. Separable, disposable portions of the strip can be removed from the container and used to apply lotion to various parts of the human body. Optional clips or holders may be used to grasp and hold the ends of the strip portion being used.

9 Claims, 3 Drawing Sheets

LOTION APPLICATOR SYSTEM

FIELD OF THE INVENTION

This invention relates to systems, methods and devices for applying lotions, oils and the like to various parts of the human body. More particularly, this invention relates to systems and devices for applying lotions, oils, etc. to various parts of the human body conveniently and simply, without spillage or waste of the product.

BACKGROUND OF THE INVENTION

Suntanning lotions, oils and the like are widely used and are generally dispensed from tubes or bottles and then applied to various parts of the body by hand rubbing. Certain areas of the body, however, such as the back and sometimes the shoulders are difficult or impossible to reach.

Also, there are times when a person does not want to soil his or her hands with oily substances when applying such substances to portions of the body. Further, there are certain substances that are intended only for application to limited parts of the body, e.g., muscular-relief ointments.

Although various types of back washing brushes have been described, such devices are not satisfactory for application of substances as described herein. See, for example, U.S. Pat. Nos. 1,999,846; 2,631,319; 2,905,957; 2,251,767; 2,318,680; and Design No. D. 205,832. A hand-held lotion applicator is described in U.S. Pat. No. 4,483,356 which is essentially a pad affixed to the end of an elongated handle. A cosmetic applicator is described in U.S. Pat. No. 2,094,929, but such device would not be useful in the techniques described herein. A shoe polisher of another design is described in U.S. Pat. No. 933,504.

There has not heretofore been provided a lotion applicator system having the advantages and the utility of the present invention.

SUMMARY OF THE INVENTION

In accordance with the present invention there is provided a lotion applicator system in which a lotion-carrying strip is contained within a container. A free end of the strip is accessible through an aperture in the container. Separable and disposable portions or sections of the strip can be removed from the container through the aperture, as desired.

The lotion-carrying strip may be coiled or folded within the container. To facilitate separation into short, disposable portions or lengths, the strip may be perforated at various points along its length.

Optionally, inidividual clips or holders may be used to attach to each end of a separated portion of the strip so that a person need not touch the strip during use. For example, when the lotion on the strip is oily, a person may not want to have the lotion on his or her hands where it may be difficult or inconvenient to remove.

Because the separable portions of the lotion-carrying strip are disposable, it is very convenient for the user to apply the lotion where it is desired and then dispose of the used strip portion. Accordingly, there is no need to clean or store an applicator. Furthermore, the container utilized in the present invention is compact and convenient to carry or store and it keeps the lotion inside where it cannot contaminate other objects.

Also, the lotion-carrying strips described for use in the system of this invention are extremely convenient and effective for applying lotions, cremes, oils, ointments, etc. of all types to the human body, even in hard-to-reach areas.

Other advantages of the system of this invention will become apparent from the following description.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
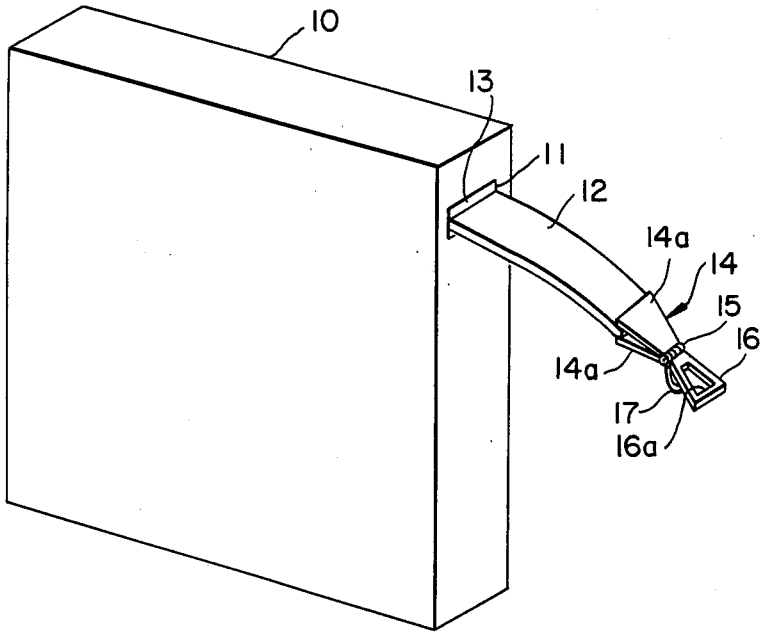
FIG. 1 is a perspective view illustrating one embodiment of the lotion applicator system of the invention.

In FIG. 1 there is shown a perspective view of one embodiment of the invention including container 10 and elongated lotion-carrying strip material 12. Container 10 includes an aperture 11 on one of its sides, as illustrated.

Preferably the container has walls which are impervious to liquids and to air so that the lotion will not leak through the package and so that the odor of the lotion is reasonably well contained. If desired, there may be included rubber or plastic seal members 13 around the aperture 11 to seal the aperture while enabling the strip 12 to be pulled therethrough.

Figure 6:
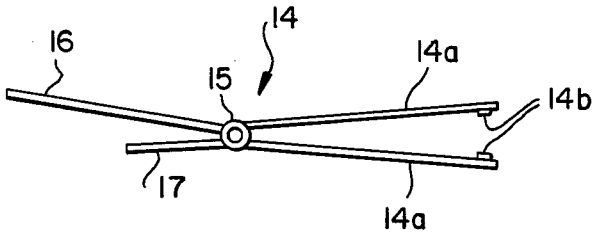
FIG. 6 illustrates one embodiment of a clip or holder which is useful in the present invention.
Figure 8:
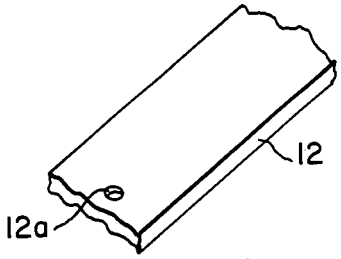
FIG. 8 illustrates one embodiment of a strip material useful in the present invention.

Clip or holder 14 (also illustrated in FIG. 6) may optionally be used to grip or grasp the end of strip 12, as shown. Clip 14 includes fingers **14*a* which are biased towards each other by means of spring 15. Arms 16 and 17 are squeezed together in order to open fingers 14*a*, much in the manner in which a clothes pin operates. Protrusions 14*b* may be included on the facing surfaces of fingers 14*a*, as illustrated in FIG. 6, for the purpose of engaging an opening 12*a* in the end of strip 12 (as illustrated in FIG. 8, for example). This assures a firm connection of the clips or holders to the strip for removal from the container and during use of the strip when applying lotion to the body. Openings 16*a* in arm 16** may accommodate the user's fingers to facilitate holding the clip during use in applying lotion to the body. The strip portion may be used even in applying lotion to a person's back, shoulders, etc. by holding each end of the strip while it is behind the back.

Other means, of course, could be used to assure a firm connection between the clip and the strip. For example, the facing surface of fingers **14*a*** could include teeth members, or ribs, or grooves, or other such means for firmly gripping the strip.

The container may have various shapes, although a rectangular shape as illustrated is convenient and economical. The size of the container may also vary, as desired.

Figure 2:
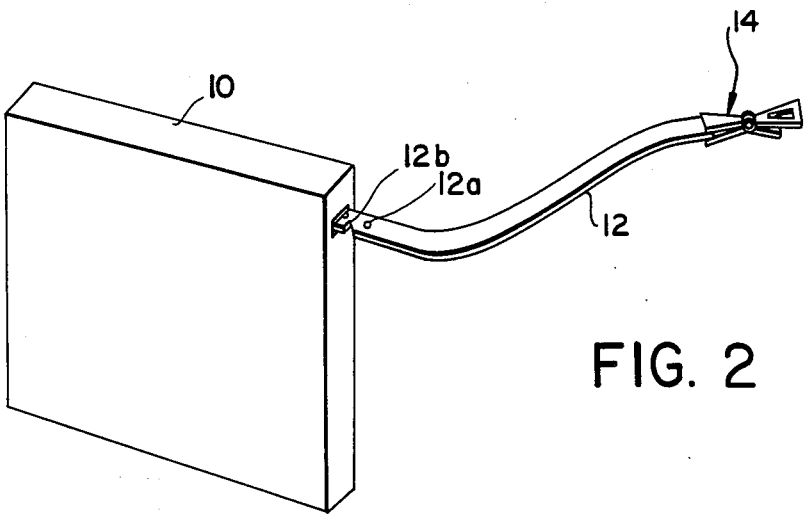
FIG. 2 illustrates removal and separation of an applicator strip from a container in accordance with the techniques of the invention.

Strip material is removed from the container by grasping the free end of the strip (with a clip 14) and pulling it through the aperture in the wall of the container. Preferably the strip 12 is perforated at various points **12*b* along its length so that separable portions of the strip may be obtained. This is illustrated in FIG. 2 where, along transverse perforation 12*b*, a convenient length of the strip 12** may be separated for use. Alternatively, if the strip is not perforated, there may be included a shearing means (such as a sharp or serrated edge) at the aperture to facilitate separation of the desired length of the portion to be used.

Figure 3:
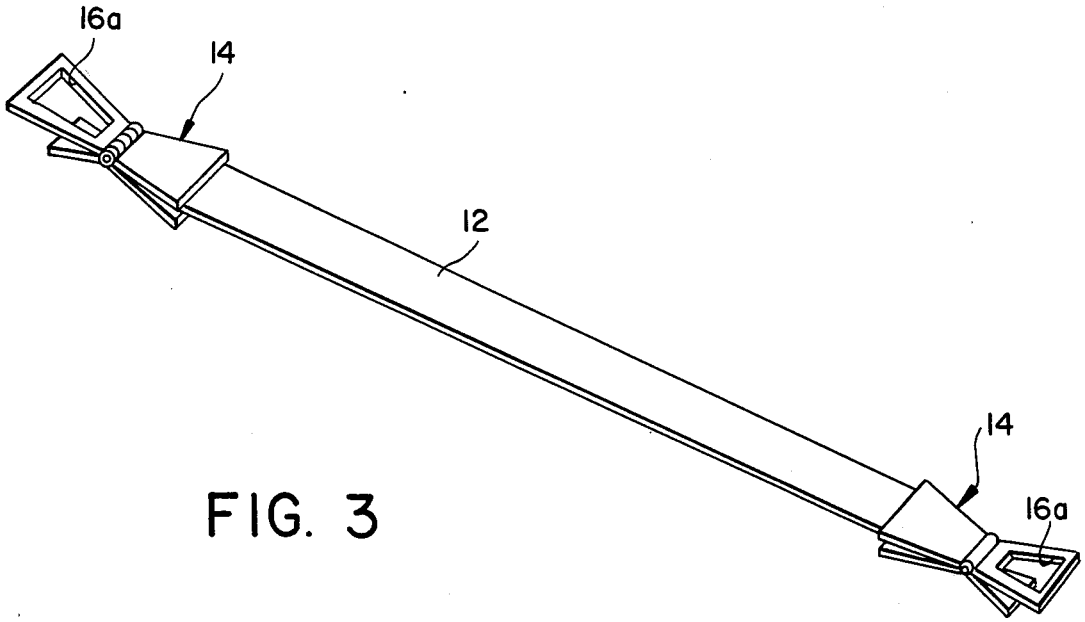
FIG. 3 shows an applicator strip with clips or holders attached to each end.

Then another clip or holder 14 may be affixed to the newly created end of strip 12, as is illustrated in FIG. 3. The length of such a usable portion of strip 12 may vary, as desired. Generally speaking, however, the length will conveniently be in the range of about 10 to about 20 inches.

Figure 4:
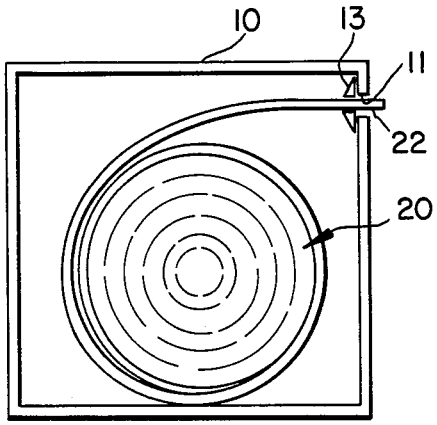
FIG. 4 is a cut-away view of one embodiment of a package of the invention.
Figure 5:
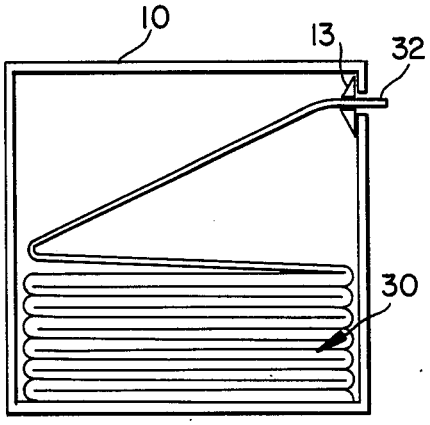
FIG. 5 is a cut-away view of another embodiment of a package of the invention.

In FIGS. 4 and 5 there are illustrated cut-away views of different embodiments of the invention. In FIG. 4 the strip material 20 is in the form of a roll within the container. The free end 22 extends through the aperture 11 and seal member 13. In FIG. 5 the strip material 30 is in the form of a stack where the strip material is folded upon itself. The free end 32 extends through the aperture 11 and seal member 13.

In the embodiments of FIGS. 4 and 5 the strip material has been pre-impregnated (e.g., at the factory prior to being placed within the container) with lotion or other desired material. Thus, there is no free liquid in the containers shown in FIGS. 4 and 5.

Figure 7:
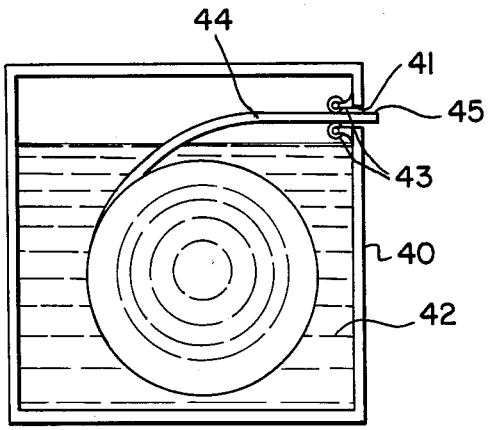
FIG. 7 is a cut-away view illustrating another embodiment of a package of the invention.

Another embodiment of a lotion applicator system of the invention is illustrated in FIG. 7. In this embodiment there is contained within container 40 a liquid 42 (e.g., lotion or other desired material). Strip material 44 is within the container 40 and is immersed in liquid 42. The free end 45 of the strip 44 is accessible through aperture 41. The strip material passes between two squeeze rolls 43 as it is withdrawn from the container. The rolls 43 act to squeeze excess liquid from the strip 44 as it is removed from the container. The strip 44 may be in roll form, as shown, or it may be in folded form in the container.

Figure 9:
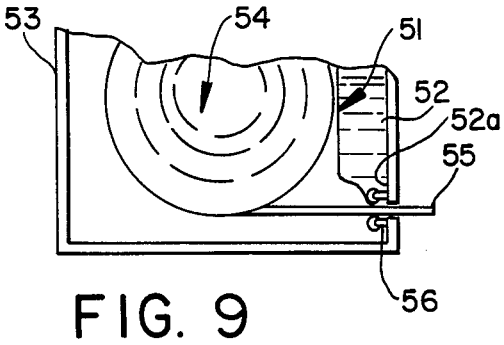
FIG. 9 is a cut-away view of yet another embodiment of the lotion applicator system of the invention.

Yet another embodiment of the lotion applicator system of the invention is illustrated in the cut-away view of FIG. 9. In this embodiment the lotion or other desired liquid 52 is contained within vial 51 which is inside of container 53. For example, vial 51 may be secured to an inside wall of container 53. At the lower end of vial 51 is an applicator roll **52*a* which is adapted to dispense liquid 52 onto strip material 55 which is being taken off roll 54. Guide roll 56 positions the strip 55 against roll 52*a***. Thus, in this embodiment the liquid is kept in a separate vial until it is needed. Then the liquid is applied only to portions of the strip which are going to be used.

The strip material which is useful in the applicator system of this invention may be cloth, plastic, foam, woven or non-woven material which is flexible, absorbant, and conformable. The width and thickness of the strip may vary. For example, the width may vary from about 2 to about 5 inches, although a convenient width is about 3 to 4 inches. The thickness may vary from about 0.25 to 2 millimeters, depending upon the absorbancy of the material and its strength and flexibility.

The term "lotion" as used herein is intended to refer to any material which may be carried on the strip for application to the human body. For example, common lotions which may be handled in this manner include suntanning oils and cremes, muscular-relief ointments, body cremes, and the like.

Other variants are possible without departing from the scope of the present invention. For example, after all of the strip material from a particular container as described herein has been used, the container may either be disposed of or a fresh roll or stack of strip material may be inserted into such container for use in the same manner as the original material. Also, clips or holders of different designs than those illustrated herein may be used, if desired. Of course, the strips may be used without any sort of holders also, if desired.

What is claimed is:

1. A lotion applicator system comprising:

(a) a container having an aperture through one face thereof; and (b) a continuous, lotion-carrying strip contained within said container, said strip having a free end which is accesssible through said aperture; wherein said strip is perforted at intervals along its length to provide perforations extending transversely of said strip from one edge to the opposite edge of said strip; wherein separable, disposable portions of said strip are adapted to be removed from said container through said aperture; wherein said strip includes apertures therethrough adjacent said perforations, said apertures being larger than said perforations;and wherein each said aperture is centrally located between said edges of said strip; and (c) clips which are adapted to be attached to the ends of a said portion of said strip removed from said container; wherein said clips include protrusions which are smaller than said apertures and which are adapted to engage said apertures in a said strip portion without piercing or tearing of said strip portion.

2. A lotion applicator system in accordance with claim 1, wherein said strip is coiled within said container.

3. A lotion applicator system in accordance with claim 1, wherein said strip is folded within said container.

4. A lotion applicator system in accordance with claim 1, wherein said strip has been pre-impregnated with said lotion.

5. A lotion applicator system in accordance with claim 1, wherein said strip is immersed in said lotion in said container.

6. A lotion applicator system in accordance with claim 1, wherein said clips include openings to facilitate grasping and holding by a user's fingers.

7. A lotion applicator system in accordance with claim 1, further including a vial within said container, said vial containing lotion, wherein said vial is adapted to dispense said lotion onto said strip material when said strip material is removed from said container.

8. A method for applying lotion to a desired part of the human body comprising:

(a) providing a container having an aperture through one face thereof and containing a continuous, lotion-carrying strip having a free end which is accessible through said aperture; wherein said strip is perforated at intervals along its length to provide perforations extending transversely of said strip from one edge to the opposite edge of said strip; wherein each said line of perforations defines a separation point between adjoining ends of successive strip portions; wherein each said strip portion includes an aperture therethrough adjacent each said line of perforations; wherein each said aperture is larger than said individual perforations; and wherein each said aperture is centrally located between said edges of said strip;

(b) providing clips which are adated to be attached to the ends of a portion of said strip removed from said container; wherein said clips include protrusions which are smaller than said apertures and which are adapted to engage said apertures in a said strip portion without piercing or tearing of said strip portion;

(c) removing a portion of said strip from said container and attaching said clips to said ends of said strip;

(d) contacting said part of the human body with said portion of said strip.

9. A lotion applicator system comprising:

(a) a container having an aperture through one face thereof;

(b) a continuous, lotion-carrying strip contained within said container, said strip having a free end which is accessible through said aperture; wherein said strip is perforated at intervals along its length to provide spaced lines of perforations extending transversely across said strip from one edge to the opposite edge of said strip; wherein each said line of perforations defines a separation pont between adjoining ends of successive strip portions; wherein each said strip portion includes an aperture therethrough adjacent each said line of perforations; wherein each said aperture is larger than said individual perforations; and wherein each said aperture is centrally located between said edge of said strip;

(c) clips which are adapted to be attached to the ends of a said portion of said strip removed from said container; wherein said clips include protrusions which are adapted to engage said apertures in a said strip portion; wherein said protrusions have a diameter smaller than the diameter of said apertures; whereby said clips are firmly connected to said strip portion without piercing or tearing of said strip portion.

* * * * *